US009408010B2

(12) United States Patent
Harma et al.

(10) Patent No.: US 9,408,010 B2
(45) Date of Patent: Aug. 2, 2016

(54) AUDIO SYSTEM AND METHOD THEREFOR

(75) Inventors: Aki Sakari Harma, Eindhoven (NL); Mun Hum Park, Eindhoven (NL); Georgina Tryfou, Agia Paraskevi Athens (GR)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 67 days.

(21) Appl. No.: 14/116,357

(22) PCT Filed: May 14, 2012

(86) PCT No.: PCT/IB2012/052382

§ 371 (c)(1), (2), (4) Date: Nov. 8, 2013

(87) PCT Pub. No.: WO2012/160472

PCT Pub. Date: Nov. 29, 2012

(65) Prior Publication Data

US 2014/0072121 A1 Mar. 13, 2014

(30) Foreign Application Priority Data

May 26, 2011 (EP) ..... 11167581

(51) Int. Cl.

*H04R 5/00* (2006.01)
*H04S 3/00* (2006.01)
*H04S 5/00* (2006.01)

(52) U.S. Cl.

CPC . *H04S 3/00* (2013.01); *H04S 5/005* (2013.01); *H04S 2400/11* (2013.01); *H04S 2400/13* (2013.01); *H04S 2420/07* (2013.01)

(58) Field of Classification Search

CPC H04R 2499/11; H04R 3/005; H04S 2400/11; H04S 2400/13; H04S 2420/07; H04S 3/00; H04S 5/005; H04S 2400/01; H04S 2420/01; H04S 3/008; H04S 7/305; H04S 2400/15; H04S 2420/03; H04S 2420/11; H04S 2420/13; H04S 3/02; H04S 5/00; H04S 7/40; G10L 19/025; G10L 19/032; G10L 21/038; G10L 21/04; G10L 19/008; G10L 19/0204; G10L 19/022; G10L 19/20; G10L 21/0364; G10L 25/18; G10L 15/08; G10L 15/22; G10L 17/02; G10L 17/20

USPC ..... 318/1–3, 17–23, 56–58, 104, 300; 700/94; 704/200.2, 205, 500, 200, 201, 704/230

See application file for complete search history.

(56) References Cited

U.S. PATENT DOCUMENTS 4,837,825 A 6/1989 Shivers
5,999,630 A 12/1999 Iwamatsu (Continued)

FOREIGN PATENT DOCUMENTS

EP 2065885 A1 6/2009
EP 2154911 A1 2/2010

(Continued)

OTHER PUBLICATIONS

Duxbury et al: "Separation of Transient Information in Musical Audio Using Multiresolution Analysis Techniques"; Proceedings of COSST G-6 Conference on Digital Audio Effects, Dec. 2001, pp. 1-4.

(Continued)

*Primary Examiner* — Lun-See Lao

(57) ABSTRACT

An audio system comprises a receiver which receives an input audio signal. A decomposer (103) decomposes the audio signal into at least a transient component signal and a non-transient component signal. An output circuit (105, 107, 109) then generates a first output audio signal in response to a weighted combination of the transient component signal and the non-transient component signal. In the combination the weighting of the transient component signal is different than the weighting of the non-transient component signal. A new signal with different emphasis of specific sound characteristics can be achieved. The approach may be particularly suited to generation of new spatial audio channels from an existing spatial audio channel, such as in particular the generation of an elevated channel from audio signals of a lower channel.

14 Claims, 7 Drawing Sheets

(56) References Cited

U.S. PATENT DOCUMENTS

| | | | | |
|---|---|---|---|---|
| 6,285,767 | B1 | 9/2001 | Klayman | |
| 6,496,584 | B2 | 12/2002 | Irwan et al. | |
| 7,412,380 | B1 | 8/2008 | Avendano et al. | |
| 8,438,017 | B2 * | 5/2013 | Jeong | G10L 19/04 704/219 |
| 2006/0031075 | A1 * | 2/2006 | Oh | G10L 21/038 704/500 |
| 2007/0263888 | A1 | 11/2007 | Melanson | |
| 2008/0008324 | A1 | 1/2008 | Sim et al. | |
| 2008/0175394 | A1 | 7/2008 | Goodwin | |
| 2009/0198501 | A1 | 8/2009 | Jeong et al. | |
| 2009/0245539 | A1 * | 10/2009 | Vaudrey | H03G 7/002 381/109 |
| 2011/0085677 | A1 * | 4/2011 | Walsh | H03G 9/005 381/94.3 |
| 2012/0051549 | A1 * | 3/2012 | Nagel | G10L 21/04 381/56 |

FOREIGN PATENT DOCUMENTS

| | | | |
|---|---|---|---|
| EP | 2214165 | A2 | 8/2010 |
| JP | 08146974 | A | 6/1996 |
| JP | 2001016698 | A | 1/2001 |
| WO | 2010027882 | A1 | 3/2010 |

OTHER PUBLICATIONS

Avendano et al: "A Frequency-Domain Approach to Multichannel Upmix"; J. Audio Eng. Soc., vol. 52, No. 7/8, pp. 740-749, Jul./Aug. 2004.

Bai et al: "Upmixing and Downmixing Two-Channel Stereo Audio for Consumer Electronics"; IEEE Trans. Consumer Electronics, vol. 53, No. 3, pp. 1011-1019, Aug. 2007.

Bello et al: "A Tutorial on Onset Detection in Music Signals"; IEEE Transactions on Speech and Audio Processing, vol. 13, No. 5, Sep. 2005, pp. 1035-1047.

Faller et al: "Multiple-Loudspeaker Playback of Stereo Signals"; J. Audio Eng. Soc., vol. 54, No. 11, pp. 1051-1064.

Lee et al: "Immersive Virtual Sound Beyond 5.1 Channel Audio"; Presented at the 128th AES Convention, London, UK, Convention Paper 8117, pp. 1-9.

Irwan et al: "Two-To-Five Channel Sound Processing", J. Audio Eng. Soc., vol. 50, No. 11, pp. 314-926, Nov. 2002.

* cited by examiner

AUDIO SYSTEM AND METHOD THEREFOR

CROSS-REFERENCE TO PRIOR APPLICATIONS

This application is the U.S. National Phase application under 35 U.S.C. §371 of International Application No. PCT/IB2012/052382, filed on May 14, 2012, which claims the benefit of European Patent Application No. 11167581.5, filed on May 26, 2011. These applications are hereby incorporated by reference herein.

FIELD OF THE INVENTION

The invention relates to an audio system and a method therefor, and in particular, but not exclusively, to a spatial audio system.

BACKGROUND OF THE INVENTION

Audio reproduction has become increasingly complex and varied in recent decades. Traditionally audio was reproduced as a single mono signal or possibly as a spatial two channel (stereo) signal. Furthermore, modification and adaptation of audio was typically limited to level adjustments or equalization. However, nowadays many different and complex audio systems are widely used including spatial audio systems, such as e.g. surround sound home cinema systems. Furthermore, signal processing and adaptation has become increasingly complex and advanced signal processing has been used to adjust various parameters of the rendered sound including for example relative delay differences between channels, emphasis of speech etc.

However, there is still a desire to further develop, enhance and improve audio rendering and reproduction. Indeed, there is still a drive to develop further approaches for allowing improved, or more varied audio signals to be provided to a user. In particular, sound rendering proving an improved spatial user experience is highly desirable.

Indeed, it has recently been proposed to enhance conventional two-dimensional spatial audio systems (such as 5.1 surround sound systems) with additional loudspeakers that are out of the horizontal two dimensional plane. Specifically, it has been proposed to add elevated front speakers that are positioned higher than the traditional front (or center) speakers. However, as audio content is typically only available in traditional two-dimensional surround sound formats, it is necessary to generate these elevated sound channels from the existing two-dimensional channels. It has been proposed to generate such elevated sound channels based on the correlation between signal components in different channels. However, the current approaches tend not to provide optimal performance, and in many cases result in a spatial experience which is not as convincing as would be desired. Indeed, typically the spatial effect of the elevated speakers is considered not to be significant enough.

Essentially the same restrictions typically also apply to loudspeakers placed at extreme sides of the listening area and virtual surround loudspeakers that can be created by directional sound reproduction methods (e.g., directional reproduction using walls and other surfaces of the room as sound reflectors), and by elimination of the sound in a desired direction (e.g., using an acoustic dipole source).

Hence, an improved audio system would be advantageous and in particular a system allowing increased flexibility, new or improved audio effects, improved adaptation and/or modifications of the rendered audio, an improved spatial experience, improved generation of additional spatial channels (and in particular elevated channels) and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio system comprising: a receiver for receiving an input audio signal; a decomposer for at least partially decomposing the input audio signal into at least a transient component signal and a non-transient component signal; and a first circuit for generating a first output audio signal in response to a weighted combination of the transient component signal and the non-transient component signal, wherein a weighting of the transient component signal is different than a weighting of the non-transient component signal.

The invention may allow an improved audio system. The audio system may in many scenarios provide additional audio effects and processing and may in many scenarios provide a more flexible, variable and/or improved audio experience.

The audio system may e.g. generate a signal providing different spatial characteristics to a user e.g. in a spatial audio system. In some embodiments, the audio system may generate an audio signal with reduced or increased emphasis of fast and sudden variations in the signal compared to more slow variations. The approach may for example be used to emphasize or deemphasize specific types of sound; e.g. sounds such as explosions may be emphasized or deemphasized.

The combination may be a weighted summation.

In some embodiments the first circuit may comprise a first weight circuit for generating a first weighted signal by applying a first weight to the transient component signal; a second weight circuit for generating a second weighted signal by applying a second weight to the non-transient component signal, the second weight being different from the first weight; and a circuit for generating the first output signal by combining the first weighted signal and the second weighted signal.

The first output signal is a sound render signal which may be reproduced by a sound transducer. The first output signal may specifically be a sound transducer drive signal, such as specifically a loudspeaker drive signal. The audio system may comprise means for rendering the first output signal from a sound transducer.

In accordance with an optional feature of the invention, the input audio signal is a signal of a first spatial audio channel, and the first output signal is a signal of a second spatial audio channel associated with a different nominal position than the first spatial audio channel.

The invention may provide an improved and/or modified effect in a spatial audio system. In particular, the approach may generate a new spatial channel based on an input spatial channel. The new spatial channel may for example reflect different sound characteristics associated with sound from different directions in a typical audio environment. For example, the approach may generate sound suitable for rendering from positions/directions that are different than the conventional sound positions. In particular, the approach may provide an efficient and advantageous way of generating suitable audio for spatial channels corresponding to elevated positions from an input audio signal for a non-elevated spatial channel and/or for spatial channels corresponding to wide positions from an input audio signal for a closer position.

The independent weighting of transient component signals and non-transient component signals may provide a particularly advantageous variation of a characteristic that corresponds to typically perceived differences of sound from different positions, and in particular from different elevations.

In accordance with an optional feature of the invention, at least one of a weighting of the transient component signal and a weighting of the non-transient component signal is frequency dependent.

This may allow a high degree of sound effects and may allow an improved adaptation of the sound rendering to provide suitable perceptional cues to the listener.

In accordance with an optional feature of the invention, the audio system further comprises a second circuit for generating a second output audio signal in response to a weighted combination of the transient component signal and the non-transient component signal, wherein a weighting of the transient component signal and a weighting of the non-transient component signal are different than for the first output audio signal.

The audio system may upmix a single input audio signal to two (or more) output audio signals. The output signals can have different characteristics to provide different perceptual impact to a listener. In particular, signals with different emphases of fast and sudden sound components relative to more permanent sound components can be provided.

In accordance with an optional feature of the invention, the audio system further comprises a driver for rendering the first output audio signal from a first loudspeaker and rendering the second output audio signal from a second loudspeaker.

This may provide an advantageous generation of a spatial sound output, and may specifically in many embodiments provide an enhanced spatial experience. In many embodiments one spatial channel may be rendered from two (or more) sound transducers with the characteristics of the sound rendered from each sound transducer being different. The different characteristics may reflect typical differences in characteristics perceived for different directions in a typical sound environment.

In accordance with an optional feature of the invention, the input audio signal is a signal of a first spatial audio channel, the first output audio signal is a signal of a second spatial audio channel, and the second output audio signal is a signal of a third spatial audio channel associated with a different nominal position than the second spatial audio channel.

The audio system may provide a spatial upmixing wherein a plurality of spatial channels is generated from a single input channel. The approach may allow additional spatial channels to be generated thereby providing an enhanced spatial experience. The additional spatial channels may be generated to have different perceptional characteristics and may specifically be adapted to correspond to sound characteristics typically associated with various audio source positions.

In accordance with an optional feature of the invention, a nominal position of the second spatial audio channel is elevated relative to a nominal position of the second spatial audio channel.

The approach may provide a particularly advantageous way of upmixing a spatial signal to generate a new spatial channel corresponding to an elevated position relative to the spatial signal. For example, a particularly advantageous elevated front channel may be generated from a front channel of a conventional two dimensional spatial signal, such as from a 2-channel stereo, or a 5.1-channel surround signal.

The variation of the emphasis of fast and sudden variations relative to more static sounds may provide a particularly suitable adjustment of characteristics associated with the height of the sound transducer position.

The nominal position of the second spatial audio channel may in many embodiments advantageously be elevated relative to a nominal position of a spatial input channel of the input audio signal.

In accordance with an optional feature of the invention, a weighting of the transient component signal relative to the non-transient component signal is higher for the first output audio signal than for the second output audio signal.

This may provide an improved spatial experience in many embodiments. In particular, a more naturally sounding sound stage may be perceived by a listener.

In accordance with an optional feature of the invention, a weighting of the non-transient component signal in the first output audio signal is at least ten times lower than a weighting of the transient component signal.

This may provide particularly advantageous performance in many scenarios. In particular it may in many scenarios provide improved perceptional characteristics from an elevated sound transducer. In many embodiments, the weighting of the non-transient component signal in the first output signal may advantageously be zero.

In accordance with an optional feature of the invention, a weighting of the transient component in the first output audio signal and a weighting of the transient component signal in the second output audio signal are frequency dependent.

This may provide a more flexible and/or improved sound rendering. In many embodiments it may provide an improved and more naturally sounding spatial experience.

In accordance with an optional feature of the invention, the weighting of the transient component in the first output audio signal increases for increasing frequencies and the weighting of the transient component signal in the second output audio signal reduces for increasing frequencies.

This may provide a more flexible and/or improved sound rendering. In many embodiments it may provide an improved and more naturally sounding spatial experience.

In accordance with an optional feature of the invention, a combined weighting of the transient component in the first output audio signal and in the second output audio signal is substantially constant.

This may provide an improved sound rendering in many embodiments. The combined weighting may be substantially constant for frequencies in the audio band. For example, the combined weighting may vary less than 10% in the frequency band from 400 Hz to 4 kHz. The transient component signals may be distributed across the two output signals with the distribution changing with frequency.

In accordance with an optional feature of the invention, the audio system further comprises: a first filter for generating a first spatial output audio signal in a first frequency band from the first output audio signal; a second filter for generating a second spatial output audio signal in a second frequency band from the first output audio signal; wherein the first frequency band is different from the second frequency band and the first spatial output audio signal is associated with a different nominal position than the second spatial output audio signal.

This may provide a more flexible and/or improved sound rendering. In many embodiments it may provide an improved and more naturally sounding spatial experience.

In accordance with an optional feature of the invention, the first frequency band comprises higher frequencies than the second frequency band, and a nominal position for the first spatial output audio signal is elevated relative to a nominal position for the second spatial output audio signal.

This may provide an improved and more naturally sounding spatial experience in many embodiments.

According to an aspect of the invention there is provided a method of operation for an audio system, the method comprising: receiving an input audio signal; at least partially decomposing the input audio signal into at least a transient component signal and a non-transient component signal; and generating a first output audio signal in response to a weighted combination of the transient component signal and the non-transient component signal, wherein a weighting of the transient component signal is different than a weighting of the non-transient component signal.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a spatial surround system, and in particular to a home cinema audio system. However, it will be appreciated that the invention is not limited to this application but may be applied to many other audio rendering and processing applications.

Figure 1:
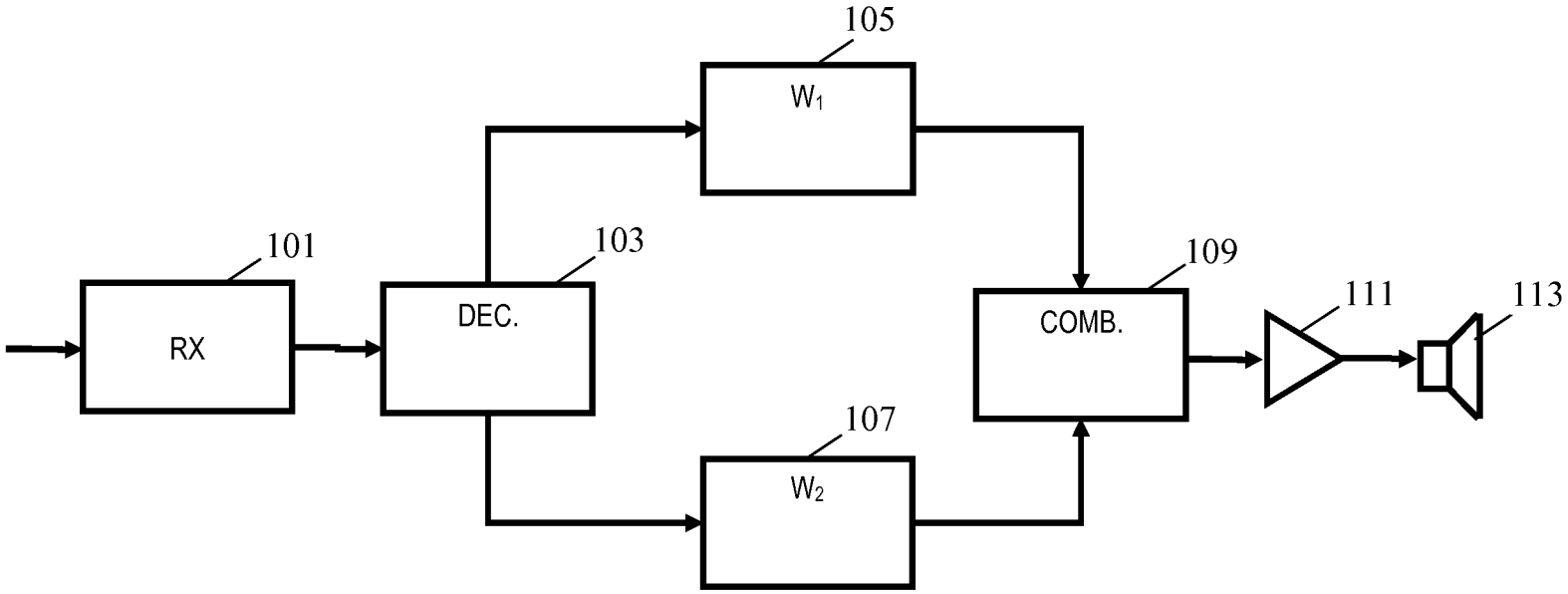
FIG. 1 illustrates an example of elements of an audio system in accordance with some embodiments of the invention.

FIG. 1 illustrates an example of elements of an audio system in accordance with some embodiments of the invention.

The audio system comprises a receiver 101 which receives an input audio signal. The input audio signal may be received from any suitable internal or external source, such as for example a DVD player, a memory, a network connection etc. In some embodiments, the received audio signal may be an encoded audio signal and the receiver 101 may comprise functionality for decoding the encoded audio signal to provide a decoded audio signal.

The receiver 101 is coupled to a decomposer 103 which receives the audio signal. The decomposer 103 is arranged to decompose the audio signal into a transient component signal and a non-transient component signal. In the following the audio signal is decomposed only into a transient component signal and a non-transient component signal, but it will be appreciated that in some embodiments the audio signal may be decomposed into more components, including for example a sinusoidal component.

In the example, the audio signal is thus divided into a signal component that predominantly represents the sudden changes in the characteristics of the signal and another signal component that predominantly represents slower and more static characteristics of the audio signal.

A transient may be considered to be a short-time (e.g., 1-200 ms) increase in the signal amplitude by more than a certain threshold (e.g., 1 dB) relative to a long-term (e.g. >200 ms) signal amplitude that occurs simultaneously at two or more non-overlapping frequency bands (where the bandwidth is, for example, ⅓ of an octave).

The signal amplitude can be interpreted as the RMS value of the signal and the signal may contain some pre-processing such as spectrum whitening or spectrum weighting using a fixed or adaptive filter.

The decomposer 103 is coupled to a first weight circuit 105 which is fed the transient component signal. The first weight circuit 105 is arranged to apply a weight to the transient component signal to generate a weighted transient component signal. As a simple example, the weight may be a simple scalar multiplication. In more complex embodiments a frequency dependent and/or complex weight may be applied or the weights may include filtering of the transient component signal.

The decomposer 103 is also coupled to a second weight circuit 107 which is fed the non-transient component signal. The second weight circuit 107 is arranged to apply a weight to the transient component signal to generate a weighted non-transient component signal. As a simple example, the weight may be a simple scalar multiplication. In more complex embodiments a frequency dependent and/or complex weight may be applied or the weights may include filtering of the transient component signal.

The first and second weight circuits 105, 107 are coupled to a combiner 109 which generates an audio output signal by combining the weighted transient component signal and the weighted non-transient component signal. In a low complexity example, the combiner 109 may simple perform an addition of the two weighted signals.

In the system, the weights for the transient component signal and the non-transient component signal are different. Thus, the system generates an output signal in which there is a different emphasis of transient and non-transient characteristics. In some embodiments, the transient properties of the input audio signal may be attenuated in the output audio signal and in other embodiments the transient properties of the input audio signal may be amplified in the output audio signal. Indeed, in some embodiments, the emphasis of the transient properties may be dynamically modified either automatically (e.g. in dependence on characteristics of the signal) or manually.

The inventors have realized that the modification of the relationship between transient and non-transient components of a signal can provide a highly advantageous modification of the human perception of the provided sound. In particular, the inventors have realized that the spatial perception and experience from an audio signal can be modified by varying the relative emphasis of transient and non-transient components.

As another example, the approach of FIG. 1 may be used to provide an improved adaptation of the rendered sound level to suit users.

As a specific example, in many action movies the sound track may contain a lot of loud sounds of explosions which may be present in all channels of the stereo or surround audio mix. For many people, such sounds are considered too loud and therefore they prefer to reduce the playback amplitude. However, this will also reduce the audibility of the speech and other important sounds in the sound track. It has been proposed that this could be solved by using non-linear compression of the waveform which reduces the amplitude of louder parts of the sound more than quieter parts. However, the actual amplitude of the explosive sounds is usually not significantly louder than the other parts of the audio signal. Therefore, non-linear compression for the attenuation of the louder parts of the sound would lead to similar reduction in the amplitudes of both e.g. a sound of a shot or a sound of a human voice.

This problem may be addressed in the system of FIG. 1 by reducing the weight of the transient component signal relative to the weight of the non-transient component signal thereby providing a more flexible and advantageous adaptation of the rendered sound level. E.g. the volume of explosions may be reduced without reducing the volume of dialogue.

In the specific example of FIG. 1, the input audio signal is a signal of a spatial audio channel and the output audio signal is provided as another spatial audio channel. A spatial audio channel is associated with a nominal position. Thus, a spatial audio channel is not merely intended to be rendered to the user, but is intended to be rendered from a specific position (or area) relative to the listener. The nominal position of a spatial channel may be a relative position with respect to other spatial channels and/or may be a relative position with respect to other spatial channels.

For example, a widely used spatial surround sound system is a five channel system wherein spatial channels are provided corresponding to speaker positions positioned around a listening position with a speaker directly in front of the listening position (the centre speaker), a speaker to the front left of the listening position (the front left speaker), a speaker to the front right of the listening position (the front right speaker), a speaker to the rear left of the listening position (the left surround speaker), and a speaker to the rear right of the listening position (the right surround speaker).

The approach of FIG. 1 may be used to generate a new spatial channel from another spatial channel. In particular, when modifying the emphasis between transient and non-transient signal components, a signal may be generated which is suitable for rendering from a different position than the nominal position of the input channel. In particular, the inventors have realized that such a modification and transient selective rendering provides various attractive ways to manipulate the perceived spatial sound image in three dimensions. For example, an increased emphasis of transients provides a signal that is suitable for rendering from e.g. an elevated position relative to the input signal or an extremely wide position.

Thus, the approach of FIG. 1 may e.g. be used to generate an elevated spatial channel relative to the input channel or may be used to generate a wide spatial channel intended to be rendered from a position which is more sideways than the nominal position of the input channel. The approach may in this way be used to generate additional spatial channels for an existing spatial audio system, and may thus effectively upmix the input signal. The approach may specifically be used to generate an additional elevated channel and may thus expand a horizontal two-dimensional surround sound system into a three dimensional surround sound system. Alternatively or additionally, the approach may be used to generate spatial channels to be rendered from wider positions thereby providing a wideband soundstage.

The newly generated channel may be generated from a speaker at a different position than the nominal position of the input channel instead of the rendering of the original channel, or may be rendered in addition to the original channel. In some embodiments, the original channel may be replaced by a rendering of two modified signals. E.g. rather than render the original signal from the nominal position, the contents may be rendered using two (or more) speakers. Thus, a distributed spatial rendering of the input spatial channel may be used.

In the following a more detailed description will be provided for a multi-channel surround sound system wherein at least one received channel is upmixed to provide a plurality of output channels. The specific example will focus on generation and rendering of elevated spatial channels, but it will be appreciated that this is merely provided as an example and that in other embodiments other spatial channels may e.g. be generated.

Figure 2:
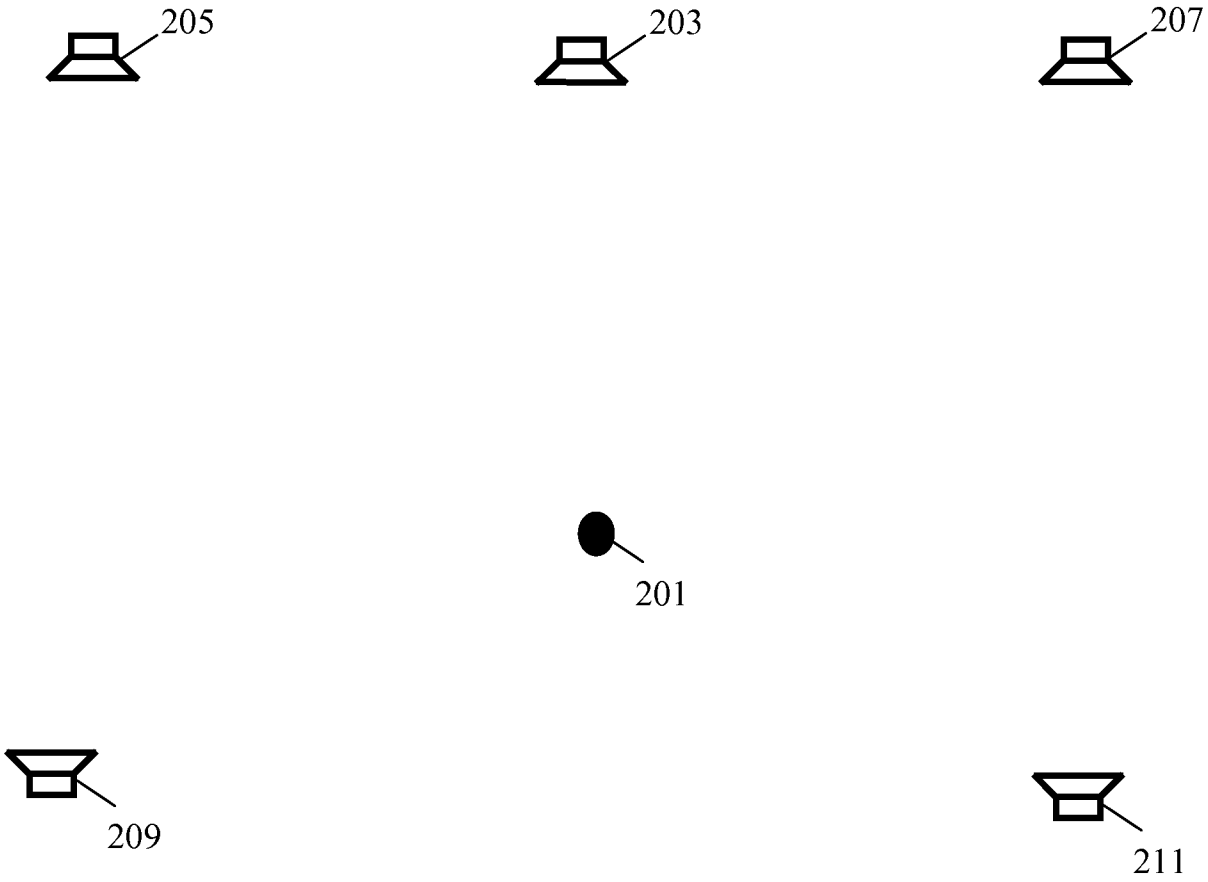
FIGS. 2-4 illustrate examples of loudspeaker setups for spatial audio systems.

Surround sound systems provide a spatial experience using a plurality of loudspeakers positioned at or close to nominal positions. Thus, a spatial multi-channel signal is provided with a number of channels each of which carries a signal intended to be rendered from a loudspeaker at a corresponding nominal position. FIG. 2 illustrates an example of a typical nominal setup for a five channel surround sound system.

In the example, the loudspeakers are assumed to be positioned around a listening position 201 with a speaker directly in front of the listening position 201 (the centre speaker 203), a speaker to the front left of the listening position (the front left speaker 205), a speaker to the front right of the listening position (the front right speaker 207), a speaker to the rear left of the listening position (the left surround speaker 209), and a speaker to the rear right of the listening position (the right surround speaker 211).

The spatial audio signal is generated to provide the desired spatial experience when the loudspeakers are positioned in accordance with the nominal setup relative to the listening position. Accordingly, users are required to position their speakers at specific locations relative to the listening position in order to achieve the optimum spatial experience.

However, although such systems may provide an interesting and exciting spatial experience, the sound rendering from a limited number of speakers tends to result in the spatial effect not being perfect. In particular, the sound stage provided tend to be relatively horizontal as the speaker positions are provided in a horizontal two-dimensional plane.

Figure 3:
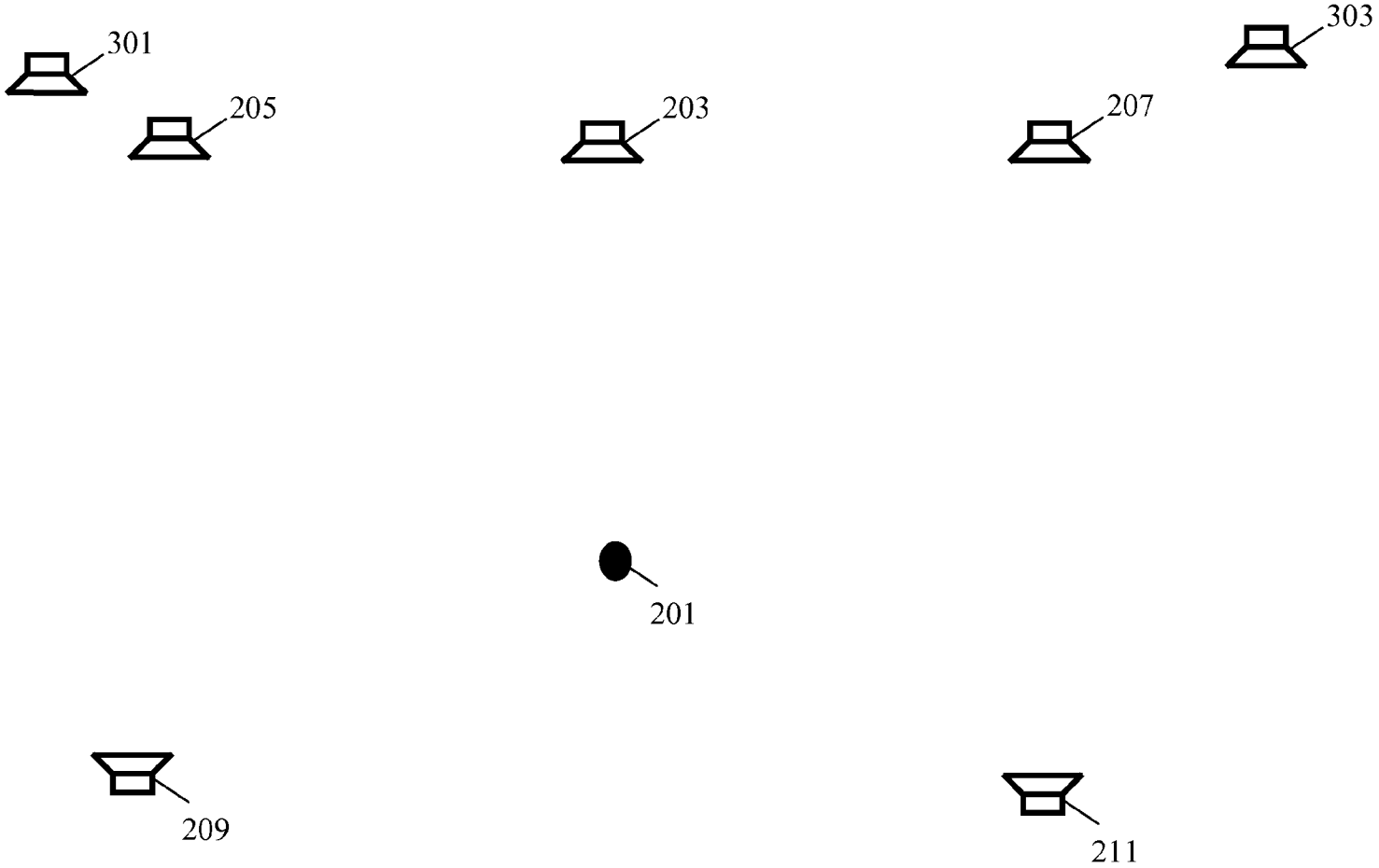
Figure 4:
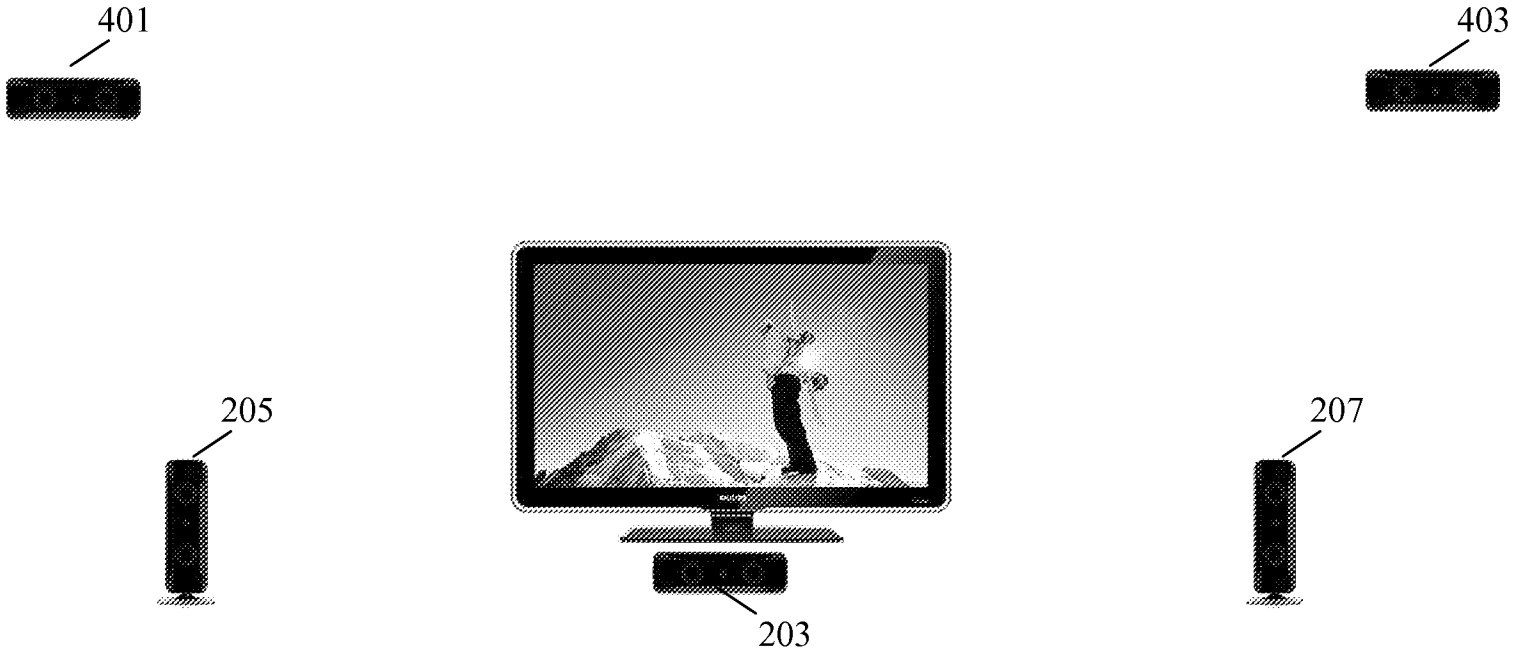

Therefore, in order to improve the spatial experience, it has been proposed to add additional spatial channels and in particular it has been proposed to add additional channels outside the two dimensional plane. In particular it has been proposed to add two additional elevated front speakers 301, 303 as illustrated in FIG. 3. These speakers are intended to be placed to the front and side of the listener but at an elevated position as indicated in the example of FIG. 4 which shows an exemplary nominal speaker setup with two elevated speakers 401, 403.

However, as most content exist only in traditional five channel (or in some cases seven channel) two-dimensional systems, the driving of these channels must be derived from existing signals in other spatial channels. However, such an upmixing from e.g. five to seven channels based on existing five channel signals must further be generated such that the combined spatial experience is improved and seems natural. This is difficult to achieve, and for example merely reusing the front side channels for the elevated front channels tend to provide a suboptimal spatial experience. In particular, it may provide a more diffuse experience of specific point sound sources and thus results in a more diffuse sound stage.

The following example describes how the approach of FIG. 1 may be used to upmix spatial channels. The example will focus on the generation of elevated front spatial channels from corresponding lower front spatial channels but it will be appreciated that in other embodiments other spatial channels may be generated.

The approach of FIG. 1 may be used to generate a front elevated channel from a front side channel. The elevated spatial channel is associated with a nominal position which is higher than the nominal position of the received channel. Thus the input channel may be rendered according to the nominal position of the input channel but in addition a new channel is generated which is rendered from a higher position. The new channel is generated by dividing the input signal into transient and non-transient components followed by a different weighting of the components after which the weighted components are combined into a drive signal.

The system specifically emphasizes the transient components of the input signal relative to the non-transient components for the elevated channel. The elevated spatial channel is thus derived from the lower spatial channel but with an increased emphasis of sudden and short term sounds in the sound space. The inventors have realized that such a transient emphasis provides a spatial signal which is highly suitable for rendering from elevated positions. Indeed, the addition of an additional elevated spatial channel with emphasis on transients provides in a much more diversified and expanded sound stage being perceived. It furthermore allows a stronger effect to be provided from the elevated loudspeakers. A naturally sounding sound stage may be provided but with additional perceived extension in the vertical direction.

In some embodiments, the weighting of the non-transient component signal may be much smaller than for the transient component signal. Indeed, in many embodiments a very advantageous sound stage generation is achieved by generating elevated channels in which the transient component signal is weighted ten or more times higher than the non-transient component signal. In many embodiments, the weighting of the non-transient component signal may be zero with only transient components being rendered from the elevated speaker position.

In the above example, an additional spatial channel is generated from a received spatial channel but with the received spatial channel being rendered without modifications. However, in other embodiments the received spatial channel may be replaced by another spatial channel being generated by the audio system. Thus, the single received spatial sound channel may be upmixed to two (or more) spatial channels that are rendered instead of the received spatial channel. This may in many embodiments provide a highly advantageous sound stage.

Figure 5:
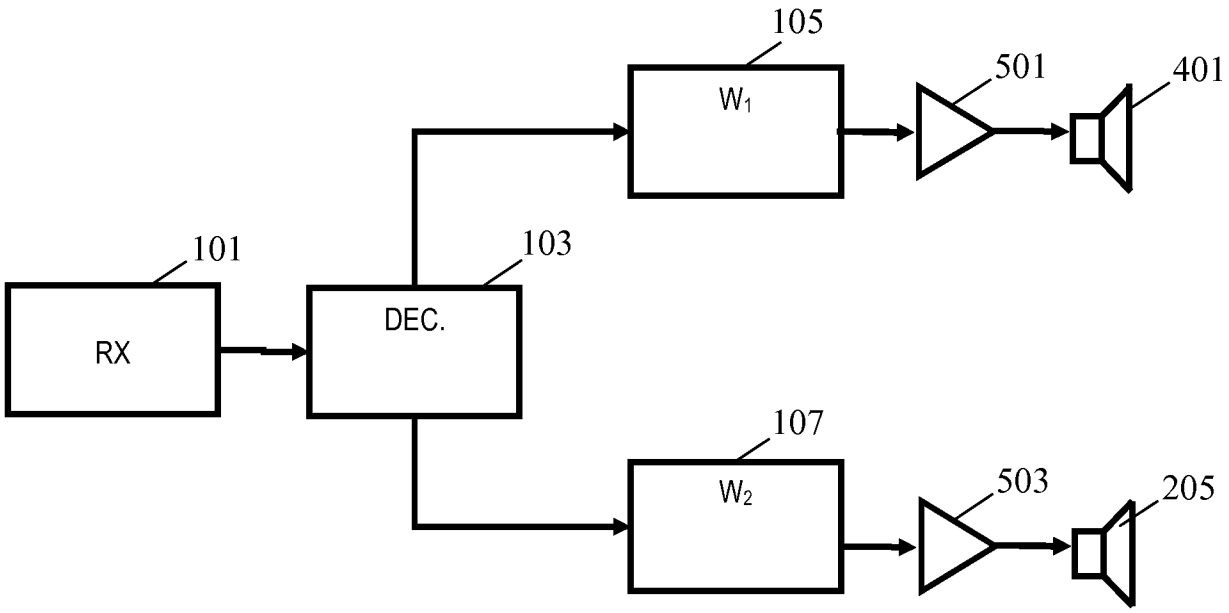
FIG. 5 illustrates an example of elements of an audio system in accordance with some embodiments of the invention.

FIG. 5 illustrates an audio system wherein two output spatial channels are generated from one input spatial channel with the rendering of the input spatial channel being replaced by rendering the two output spatial channels.

In the example, the audio system comprises a receiver 101, a decomposer 103, a first weight circuit 105, a second weight circuit 105 as described for the audio system of FIG. 1. However, in the described approach a first spatial channel is generated from the output of the first weight circuit 105 and a second spatial channel is generated from the output of the second weight circuit 107. Thus, in the example, the combination of the transient component signal and the non-transient component signal for the first spatial channel includes only the transient component signal (corresponding to the weight of the non-transient component signal being zero) and the combination of the transient component signal and the non-transient component signal for the second spatial channel includes only the non-transient component signal (corresponding to the weight of the transient component signal being zero).

In the example, the signal of the first spatial channel is fed to a first drive circuit 501 which drives the loudspeaker 401 and the signal of the second spatial channel is fed to a second drive circuit 503 which drives the loudspeaker 205. Thus, in the example one speaker renders the transient component signal and another speaker renders the non-transient component signal of the input signal. The input spatial channel is accordingly distributed across two output channels with the characteristics of the individual channel being particularly suitable for providing a different spatial perception. In particular, the spatial soundstage provided by rendering a signal with emphasized transient characteristics from an elevated position together with the rendering of a signal with de-emphasized transient characteristics from a lower positioned loudspeaker provides a highly advantageous spatial system. Thus, the approach provides a highly efficient way of upmixing a spatial input signal to provide additional spatial channels, and in particular to provide elevated spatial channels.

It will be appreciated that in the system of FIG. 5 the first and second weight circuits 105, 107 may apply static or fixed weights and may for example correspond to a simple gain setting for the signals.

Figure 6:
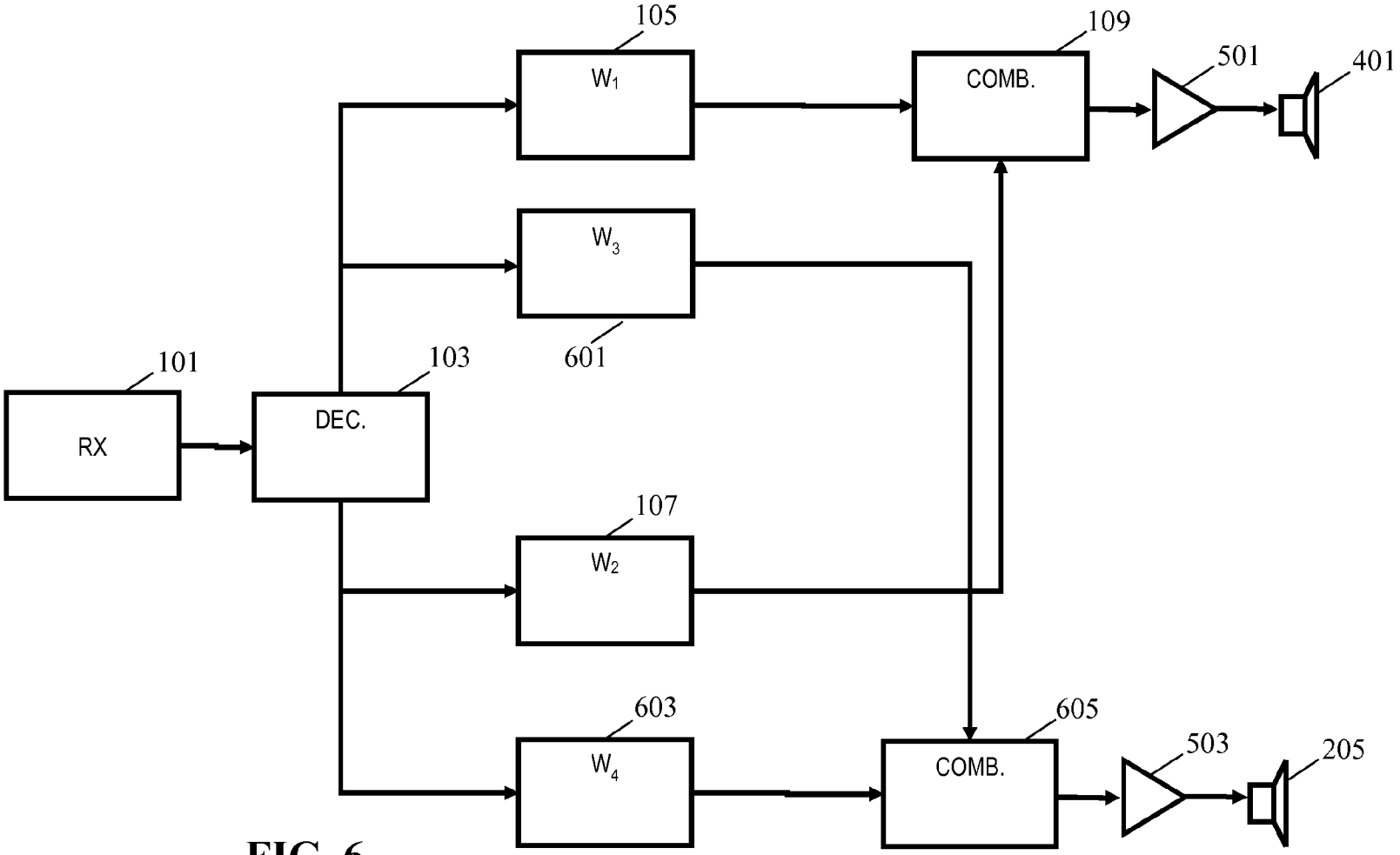
FIG. 6 illustrates an example of elements of an audio system in accordance with some embodiments of the invention.

In some embodiments, both of the upmixed channels are generated to include contributions from both the transient component signal and the non-transient component signal. An example of such an embodiment is illustrated in FIG. 6. In this example the signal for the elevated spatial channel is generated as a combination of the transient component signal and the non-transient component signal as described for FIG. 1. In addition, the audio system comprises a third weight circuit 601 which applies a third weight to the transient component signal and a fourth weight circuit 603 which applies a fourth weight to the non-transient component signal. The third and fourth weight circuits 601, 603 are coupled to a second combiner 605 which combines the weighted signals to generate the output signal for the lower spatial sound channel.

In the embodiment, the weighting between the transient and non-transient characteristics are changed for both of the output signals with respect to the input signal. Furthermore, the weighting is different for the two channels.

In the system of FIG. 6, a very flexible generation of the new spatial channels can be achieved and specifically the exact emphasis or de-emphasis of sudden or unexpected sounds can be adapted to suit the specific loudspeaker setup, user preferences etc.

The approach may specifically generate an expanded sound stage which also provides a vertical dimension. This is achieved by the addition of elevated sound channels which render sound generated from the input channels corresponding to a lower position. The use of elevated sound sources increases the immersion in the surround listening experience by creating a realistic illusion of elevated sound sources. An advantage of the described approach is that it allows a more significant spatial effect to be generated from elevated positions without resulting in the resulting sound stage appearing diffuse or unnatural. This is in particular achieved by weighting the transient component signal higher in the elevated channel than in the lower channel.

The elevated sound sources can be provided in different ways, and it will be appreciated that any suitable approach can be used.

For example, loudspeakers can be physically placed at elevated positions in the listening space, such as close to the ceiling. As another example, two or more loudspeakers can operate together to present elevated phantom images for the emphasized transient sound. As yet another example, a loudspeaker array or an ultrasonic loudspeaker can be used to direct a narrow acoustic beam towards the ceiling to produce a reflection of sound from the ceiling thereby creating an illusion that sound source is at an elevated position in the listening space.

It will also be appreciated that any suitable approach for decomposing the signal into a transient component signal and a non-transient component signal can be used without detracting from the invention.

In the systems of FIGS. 1, 5 and 6, transients are considered to correspond to signal components for which an error between the audio signal and a predicted version of the audio signal generated from previous characteristics of the signal exceeds a threshold. Specifically, a prediction algorithm may be applied to the input signal to generate a predicted signal. An error signal representing the difference between the input signal and the predicted signal is generated and compared to a threshold. If the error signal exceeds the threshold, the input audio signal is considered to correspond to a transient component and if the error signal is below the threshold the audio signal is considered to correspond to a non-transient component. Thus, in the example, the input audio signal is divided into time segments which correspond to transient components and time segments which correspond to non-transient components.

In some embodiments, the processing may be frequency selective. For example, in some embodiments the division into transients and non-transients signals may be performed in individual frequency bands.

In more detail, the input signal may be represented by x(n). The decomposition is in the example performed on a time-frequency representation of the signal, which is denoted by X(k, ω), where k is a time index and ω is a frequency variable.

A function is generated which provides an indication of when a transient event takes place in the signal x(n). This function is called "detection function (DF)". In the example, the input signal is divided into several frequency bands (e.g. by an FFT). This results in a set of sub-band signals, $x_k(n)$ (k=1, 2, . . . , M), where M is the number of frequency bands in which the signal is analyzed.

Having obtained $x_k(n)$, an adaptive linear prediction error filter is applied to short time frames of each individual (time domain) subband signal. The detection is based on the consideration that when a transient event begins, the output of the prediction will no longer be an accurate prediction and thus an increase in the value of the error signal between the subband signal and the predicted subband signal will occur. The error signal will be used as the DF which is then compared to a threshold to identify time segments corresponding to transients and time periods corresponding to non-transients.

The result is a transient time series (TTS) in each frequency band:

$$tts(n, \omega) = \begin{cases} 1, \text{ a transient event occurs} \\ 0, \text{ otherwise} \end{cases}$$

This is followed by the synthesis of a mask function based on the locations of the detected transients. This is denoted as follows:

$$M(n,\omega) \in [0,1]$$

where $$M(n,\omega) = tts(n,\omega) * w(n,\omega)$$

and w(n, ω) is a predefined window, designed to mask the onset of a transient event.

Using the mask function, the transient component signal and the non-transient component signal can be calculated:

$$Y_t(k,\omega) = M(k,\omega) \times (k,\omega)$$

$$Y_s(k,\omega) = (1 - M(k,\omega) \times (k,\omega)$$

where $y_t$ represents the transient component signal and $y_s$ represents the non-transient component signal.

Alternatively or additionally, the weights may vary as a function of frequency. The frequency variation may be correlated with the subband generation, or may be independent of the subbands. For example, in some embodiments the frequency selective decomposition may be combined with non-frequency dependent weights and in other embodiments a non-frequency selective decomposition may be performed while using frequency dependent weights.

As a specific example, the weights may be made frequency selective such that the high frequencies of transients are emphasized more in the elevated spatial channel than low frequencies of the transients. Thus, the weights applied by the first weight circuit 109 may increase for increasing frequencies and/or the weights applied by the second weight circuit 109 may decrease for increasing frequencies.

In some embodiments, the weights for the lower spatial channel may be modified correspondingly but in the opposite direction. Thus, in some embodiments, the weights applied by the third weight circuit 601 may decrease for increasing frequencies and/or the weights applied by the fourth weight circuit 603 may increase for increasing frequencies.

In particular, it may in some embodiments be advantageous if the combined weight for the transient component signal and/or for the non-transient component signal is substantially constant for frequencies in the audio band. For example, the combined weight for the transient component signal (or the non-transient component signal) may vary by no more than what results in less than variation 10% in the combined audio signal energy in the frequency range from 500 Hz to 3 kHz.

Thus, the distribution of the incoming spatial audio channel over the two spatial output channels may be varied with frequency to reflect the perceptual characteristics, and specifically to provide an improved immersive spatial experience without resulting in significant frequency selective distortion.

As a specific example, two loudspeakers (one elevated; the other on the ground level) may be used to create a phantom image of sound, with the drive signal for the lower spatial channel being indicated by $S_e$ and the drive signal for the elevated spatial channel being indicated by $S_g$. The drive signals may be generated as:

$$S_e(k,\omega) = A_e(\omega) Y_t(k,\omega)$$

$$S_g(k,\omega) = Y_s(k,\omega) + (1 - A_e(\omega)) Y_t(k,\omega)$$

with $A_e(\omega)$ and $1-A_e(\omega)$ being the frequency dependent weights reflecting a the frequency-domain window distributing the sound energy over the two channels.

As a simple example, the function $A_e(\omega)$ can be $$A_e(\omega) = \frac{2}{\omega_n} \omega$$

where $\omega_n$ is the Nyquist frequency. This function pans the transient sound so that higher-frequency content may be heard from closer to the elevated loudspeaker, while the lower-frequency is heard to originate from closer to the ground-level loudspeaker. This may provide an improved spatial experience.

In some embodiments, two spatial channels may be generated as corresponding to different frequency bands of the modified signal. For example, in the audio system of FIG. 1, the audio output may be filtered by two (or more) filters which select different frequency bands. The output of each of the filters may be used as a signal for a spatial channel to be rendered at a different position. Particularly advantageous performance may be achieved by filtering an audio signal with emphasized transient characteristics such that the higher frequency band is fed to an elevated speaker and the lower frequency band is fed to a lower speaker.

Such an approach may reflect that not all transient sound is necessarily preferred to be reproduced from above. For example, the sound of kick drum is transient, but usually expected to come from a position close to the floor, thereby reflecting the normal setup in recording studios or in live concerts. Therefore, the elevation of the transient sound can be distributed based on a frequency selective approach.

Figure 7:
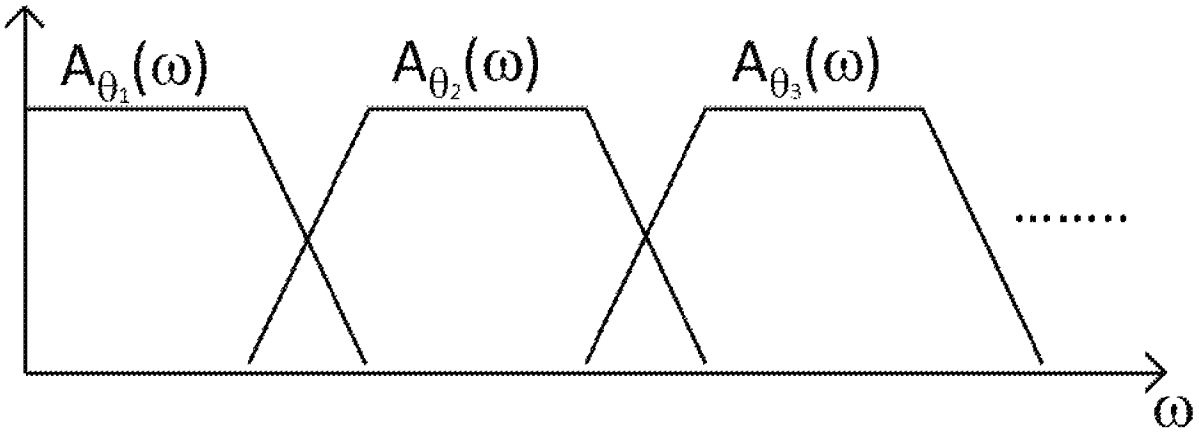
FIG. 7 illustrates an example of a cross-over filter arrangement for an audio system in accordance with some embodiments of the invention.

For example, when the transient sound is rendered by one or more vertically arranged loudspeakers, the input signal $S_\theta$ for a certain loudspeaker at angle (height) θ can be obtained by $$S_\theta(k,\omega)=A_\theta(\omega)Y_t(k,\omega)$$

Where $A_\theta(k, \omega)$ is a frequency-domain window similar to those used for cross-over networks as illustrated in FIG. 7.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio system comprising:

a receiver for receiving an input audio signal;

a decomposer for at least partially decomposing the input audio signal into at least a transient component signal and a non-transient component signal; and a first circuit for generating a first output audio signal in response to a weighted combination of the transient component signal and the non-transient component signal, wherein a weighting of the transient component signal is different than a weighting of the non transient component signal, said audio system characterized by the input audio signal being a signal of a first spatial audio channel, and the first output signal being a signal of a second spatial audio channel associated with a nominal position that is different than the nominal position of the first spatial channel, wherein the nominal position is a position from which a spatial audio channel is rendered.

2. The audio system of claim 1 wherein at least one of a weighting of the transient component signal and a weighting of the non-transient component signal is frequency dependent.

3. The audio system of claim 1 further comprising a second circuit for generating a second output audio signal in response to a weighted combination of the transient component signal and the non-transient component signal, wherein a weighting of the transient component signal and a weighting of the non-transient component signal are different than for the first output audio signal.

4. The audio system of claim 2 further comprising a driver for rendering the first output audio signal from a first loudspeaker and rendering the second output audio signal from a second loudspeaker.

5. The audio system of claim 3 wherein the input audio signal is a signal of a first spatial audio channel, the first output audio signal is a signal of a second spatial audio channel, and the second output audio signal is a signal of a third spatial audio channel associated with a different nominal position than the second spatial audio channel.

6. The audio system of claim 4 wherein a nominal position of the second spatial audio channel is elevated relative to a nominal position of the second spatial audio channel.

7. The audio system of claim 5 wherein a weighting of the transient component signal relative to the non-transient component signal is higher for the first output audio signal than for the second output audio signal.

8. The audio system of claim 2 wherein a weighting of the non-transient component signal in the first output audio signal is at least ten times lower than a weighting of the transient component signal.

9. The audio system of claim 2 wherein a weighting of the transient component in the first output audio signal and a weighting of the transient component signal in the second output audio signal are frequency dependent.

10. The audio system of claim 8 wherein the weighting of the transient component in the first output audio signal increases for increasing frequencies and the weighting of the transient component signal in the second output audio signal reduces for increasing frequencies.

11. The audio system of claim 8 wherein a combined weighting of the transient component in the first output audio signal and in the second output audio signal is substantially constant.

12. The audio system of claim 1 further comprising:

a first filter for generating a first spatial output audio signal in a first frequency band from the first output audio signal;

a second filter for generating a second spatial output audio signal in a second frequency band from the first output audio signal;

wherein the first frequency band is different from the second frequency band and the first spatial output audio signal is associated with a different nominal position than the second spatial output audio signal.

13. The audio system of claim 11 wherein the first frequency band comprises higher frequencies than the second frequency band, and a nominal position for the first spatial output audio signal is elevated relative to a nominal position for the second spatial output audio signal.

14. A method of operation for an audio system, the method comprising:

receiving an input audio signal;

at least partially decomposing the input audio signal into at least a transient component signal and a non-transient component signal; and generating a first output audio signal in response to a weighted combination of the transient component signal and the non-transient component signal, wherein a weighting of the transient component signal is different than a weighting of the non-transient component signal, said method characterized by further comprising rendering of the input audio signal being a signal of a first spatial audio channel, and the first output signal being a signal of a second spatial audio channel associated with a nominal position that is different than the nominal position of the first spatial audio channel, wherein the nominal position is a position from which a spatial audio channel is rendered.

* * * * *